US007810812B2

(12) United States Patent
Cailloux

(10) Patent No.: US 7,810,812 B2
(45) Date of Patent: Oct. 12, 2010

(54) TRANSPORT DEVICE FOR FOLDER-GLUER

(75) Inventor: Lionel Cailloux, Thonon les Bains (FR)

(73) Assignee: Bobst S.A. (CH)

( * ) Notice: Subject to any disclaimer, the term of this patent is extended or adjusted under 35 U.S.C. 154(b) by 92 days.

(21) Appl. No.: 12/104,606

(22) Filed: Apr. 17, 2008

(65) Prior Publication Data

US 2008/0258381 A1 Oct. 23, 2008

(30) Foreign Application Priority Data

Apr. 17, 2007 (EP) ..... 07007749

(51) Int. Cl.
*B65H 5/06* (2006.01)

(52) U.S. Cl. ..... 271/275; 198/604; 198/457.02

(58) Field of Classification Search ..... 271/238, 271/248, 275; 198/457.02, 604
See application file for complete search history.

(56) References Cited

U.S. PATENT DOCUMENTS 1,615,590 A * 1/1927 Low ..... 271/238
2,083,296 A * 6/1937 Davidson ..... 271/248
3,511,361 A 5/1970 Urban
5,087,028 A 2/1992 Frohlich

FOREIGN PATENT DOCUMENTS

DE 4123132 A1 3/1992

OTHER PUBLICATIONS

European Search Report dated Oct. 9, 2007 issued in corresponding European Application No. EP 07007749.0.

* cited by examiner

*Primary Examiner*—Kaitlin S Joerger
(74) *Attorney, Agent, or Firm*—Ostrolenk Faber LLP

(57) ABSTRACT

A transport device for transporting sheet elements into a folder-gluer comprising two longitudinal support structures between which there extend one or more movement slides, one or more lead screws and a drive shaft for a belt. At least one longitudinal member supports at least one endless conveyor belt driven by the shaft. The longitudinal member is mounted in sliding connection on the movement slides and on the drive shaft and is in helical connection with the lead screws. A protecting device over the drive shaft blocks user access to the shaft. It is illustrated as a profile over the shaft and slide. The protecting device transversely connects the two longitudinal support structures.

14 Claims, 2 Drawing Sheets

TRANSPORT DEVICE FOR FOLDER-GLUER

BACKGROUND OF THE INVENTION

1. Technical Field

The subject of the present invention is a transport device for transporting sheet elements of low specific mass, made of paper or cardboard, into a folder-gluer which is a machine commonly used in the packaging industry for making up cardboard boxes for example.

2. Prior Art

Traditionally, a folder-gluer comprises a series of modules and stations the number of which varies according to the complexity of the manufacturing operations that the type of box chosen entails. Such machines generally consist of a sheet feeder feeding the box production line blank by blank from a stack, an alignment module, a breaker that pre-breaks the 1st and 3rd folds between 90° and 180°, and a fold hook module, which folds the front flaps and then the rear flaps of the blank at 180°, a gluing station, a folder for folding the 2nd and 4th folds of the blank, a press which compresses the 2nd and 4th folds and sets down the boxes in a layer, and finally, a receiving module which receives the boxes keeping them pressed firmly in order to allow the glue to dry. The blanks are conveyed from one station to the next using belt-type conveyors which, through friction, grip the blanks between a bottom conveyor and a top conveyor. Traditionally, the bottom conveyor is equipped with bottom belts and the top conveyor is equipped either with top belts or with top pressing rollers.

The bottom conveyor comprises two or more longitudinal members each supporting an endless conveyor belt supported by pulleys and rollers. Each longitudinal member is mounted with the possibility of lateral sliding via bearings along one or more movement slides mounted fixedly between two longitudinal support structures. In order to adapt the lateral position of the longitudinal members to suit the format of the blanks to be processed, each longitudinal member can be moved laterally by one or more parallel screws mounted such that they can rotate between the supporting structures, the threaded portions of the screws being engaged in respective transverse tapped orifices belonging to the longitudinal members.

For each longitudinal member, the endless conveyor belt is driven via a drive shaft mounted in rotation between the supporting structures and engaged in a pulley belonging to the longitudinal member, termed the drive pulley. The drive shaft is connected by a drive line to an electric motor and so when the motor turns, the shaft is rotated.

In general, the drive shaft is in the form of a metal bar of polygonal, for example hexagonal, cross section collaborating in terms of shape with a transverse orifice formed along the axis of the drive pulley. Thus, when a longitudinal member moves laterally under the action of the adjusting screws, it slides along movement slides and along the drive shaft.

It will be noted that the power needed to operate and to drive the blanks through the machine is dependent on the width of the machine. As a result, the wider the machine the greater the forces that have to be transmitted, this meaning that the torsional strength of the shaft has to be increased, for example by increasing its cross section. Thus, the drive shaft ought to be designed merely to withstand torsion because the weight of the longitudinal members is borne by the movement slides, although in practice it is found that machine operators do not hesitate to climb onto the drive shaft in order to access certain parts of the machine. Hence, in order to prevent the drive shaft from buckling, this drive shaft is also designed to withstand the weight of a person without deflection, thus increasing the cost of manufacture of the shaft.

In addition, for safety reasons, parts of the drive shaft that are exposed to the machine operator are engaged in sleeves. A sleeve is generally in the form of a volute spring one end of which is secured to a supporting structure and the other end of which is secured to a longitudinal member, the lateral movement of the longitudinal member extending or compressing the spring. It will be readily understood that the presence of a spring such as this means that the lead screws that drive the longitudinal members have to be sized accordingly. This is because the greater the stiffness of the volute spring, the more torque will have to be exerted on the screws in order to be able to move the longitudinal members, this also entailing adapting the electric power of the motors that turn the screws accordingly.

SUMMARY OF THE INVENTION

It is one object of the present invention to remedy the aforementioned disadvantages by proposing a transport device which now no longer requires a drive shaft able to withstand deflection and which no longer requires protective sleeves.

To this end, a subject of the invention is a transport device for transporting sheet elements into a folder-gluer comprising two longitudinal support structures between which there are positioned one or more movement slides, one or more lead screws and a drive shaft. At least one longitudinal member supports at least one endless conveyor belt driven by the shaft. The longitudinal member is mounted in sliding connection on the movement slides and on the drive shaft and is in helical connection with the lead screws. The device further comprises a protecting device over the drive shaft in the sense that it is shaped and positioned to prevent user access to the drive shaft, lead screws and slides. The protecting device transversely connects the two longitudinal support structures. In one example, the device comprises a profile section over the drive shafts and particularly comprises a concave profile wherein the shafts and slides are covered by the profile and are in its concavity.

By virtue of the invention, the drive shaft is designed to withstand only torsion, thus making it possible to reduce its dimensions and therefore its mass considerably. As a result, less material is needed to manufacture the shaft, making it possible to reduce its cost of manufacture and its size.

In addition, by virtue of the invention, the drive shaft is no longer exposed to the machine operator and this means that the protective sleeves of the prior art can be omitted. As a result, the dimensions of the screws and those of the electric motors intended to turn the screws can be reduced.

Another advantage of the invention is also to make the machine easier to service and increase the life of the parts. Indeed, by virtue of the invention, the drive shaft, the lead screws and the movement slides are protected against all kinds of deposition or splashing, such as by dust or glue when the transport device according to the invention is situated at the gluing station.

Although the disclosure herein shows a bottom conveyor, it could be used for a top conveyor as well, which has the features and elements of the bottom conveyor described in a preferred embodiment.

Further objects and advantages of the invention will become more clearly apparent in the course of the description of one embodiment, which description will be given with reference to the attached drawings.

In order to define some of the terms introduced into this description and which describe the position of certain elements within the folder-gluer, mention will be made of the terms "operator end" and "non-operator end" which are used uncontestedly to refer to an end denoted with respect to the longitudinal central axis of the machine. This choice of terminology makes it possible to avoid any confusion that might arise out of conventional left and right labels which are dependent on the observer's point of view. For similar reasons, the orientation of certain movements and certain parts will be described using the customary terms "longitudinal" and "transversal" again referring to the central axis of the machine the direction of which is determined by the direction in which the sheet elements travel. Finally, it must also be emphasized that the terms "upstream" and "downstream" themselves refer to the direction in which the sheet elements travel through the folder-gluer.

PREFERRED EMBODIMENT OF THE INVENTION

Figure 1:
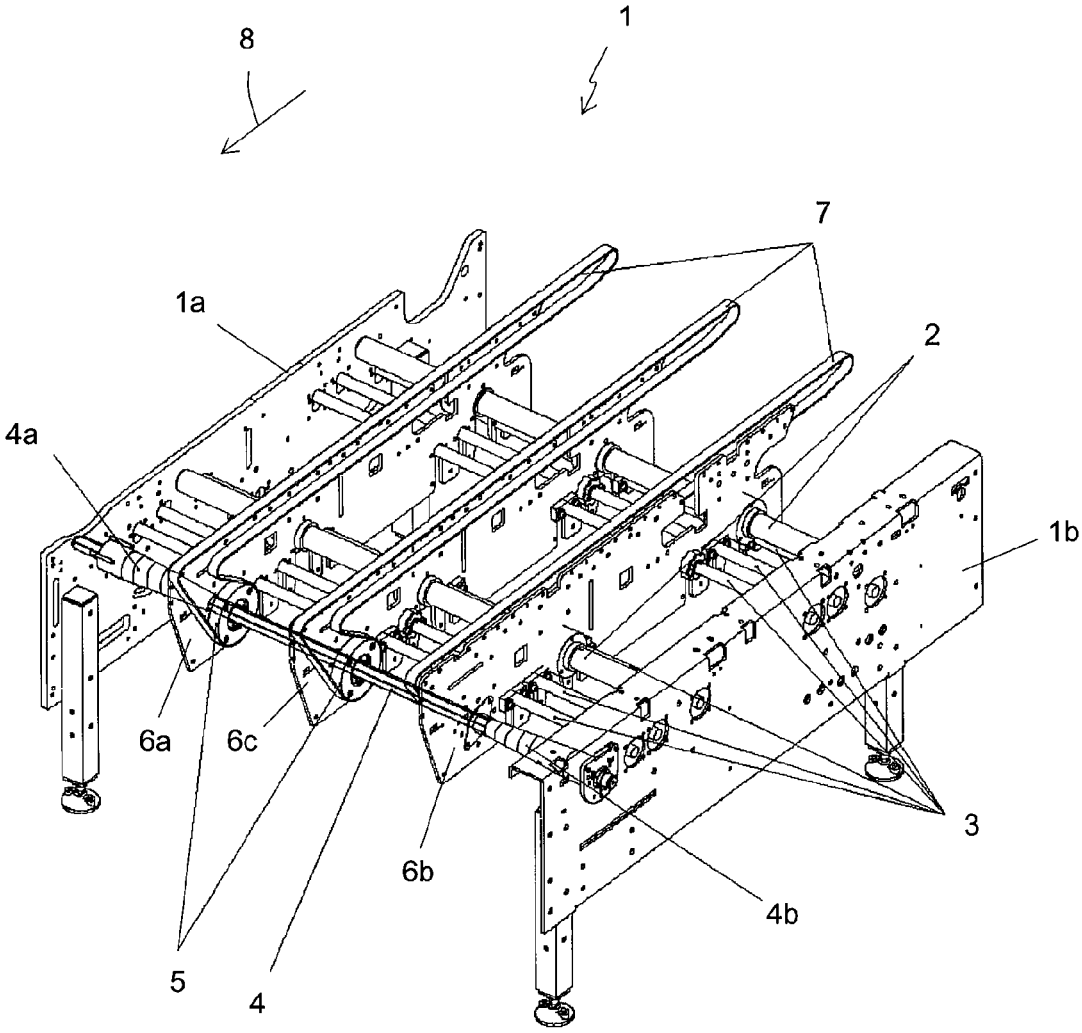
FIG. 1 is a perspective view of a bottom conveyor according to the prior art.

FIG. 1 illustrates a bottom conveyor 1 according to the prior art. The arrow 8 indicates the direction of travel of the sheet elements. A conveyor such as this generally comprises two longitudinal support structures 1*a*, 1*b* which are parallel to and distant from one another. Each support structure has two large faces: an interior face and an exterior face, the interior face of a support structure facing toward the interior face of the other support structure. In this example, the support structure 1*a* lies at the non-operator end and the support structure 1*b* lies at the operator end. Between the two support structures 1*a*, 1*b* there are transversely positioned two parallel cylindrical movement slides 2, three pairs of parallel lead screws 3 and a drive shaft 4. The movement slides 2 are built into the supporting structures 1*a*, 1*b* at each of their ends and are intended to support three parallel longitudinal members 6*a*, 6*b*, 6*c* mounted side by side and each supporting an endless conveyor belt 7 resting on a hard horizontal plane, preferably a series of rollers (which have not been depicted). Each longitudinal member can be moved transversely between the support structures 1*a*, 1*b* along the movement slides 2, according to the format of the blanks to be processed.

Devices (not depicted) for pressing the blanks against the conveyor belts 7 are positioned above certain portions of the longitudinal members 6*a*, 6*b*, 6*c*. These pressing devices may consist of a series of rollers kept lowered by springs or may consist of an endless belt the bottom strand of which is pressed downward.

To alter the transverse position of the longitudinal members 6*a*, 6*b*, 6*c*, these are mounted in a helical connection with the lead screws 3. Specifically, the transverse movement of each longitudinal member is controlled by a pair of parallel screws 3 the threaded portions of which are engaged in respective transverse tapped orifices belonging to the longitudinal member, which screws are prevented from translational movement but are free to turn between the support structures 1*a*, 1*b*. One or more electric motor(s) (not depicted) are provided for turning the screws 3.

Each endless conveyor belt 7 is supported by rollers and by a drive pulley 5. The drive pulleys 5 are coaxial and mounted free to rotate on their respective longitudinal member. To drive the conveyor belts 7, the drive shaft 4 is mounted to rotate between the support structures 1*a*, 1*b* and is engaged in the drive pulleys 5. In the example, the shaft 4 has a hexagonal cross section collaborating in terms of shape with a transverse orifice formed along the axis of each drive pulley 5. Thus, when a longitudinal member 6*a*, 6*b* or 6*c* moves laterally under the action of a pair of adjusting screws 3, it slides along the movement slides 2 and along the drive shaft 4.

For safety reasons, parts of the drive shaft 4 exposed to the machine operator are engaged in two sleeves 4*a*, 4*b*. Each sleeve 4*a*, 4*b* is in the form of a volute spring built in at both ends. The sleeve on the non-operator end, denoted 4*a*, has one end secured to the support structure 1*a* and the other end secured to the longitudinal member 6*a*, that is to say to the longitudinal member closest to the support structure 1*a*. The sleeve at the operator end, denoted 4*b*, has one end secured to the support structure 1*b* and the other end secured to the longitudinal member 6*b*, that is to say to the longitudinal member closest to the support structure 1*b*. Thus, when the shaft 4 is rotated under the action of an electric motor (not depicted), the sleeves 4*a*, 4*b* prevent any direct contact between the machine operator and the drive shaft 4, both at the non-operator end and at the operator end.

It will be noted that the lateral movement of the respective longitudinal members 6*a*, 6*b* causes the respective springs 4*a*, 4*b* to extend or to be compressed, and it will also be noted that the shaft 6 is unprotected between the respective longitudinal members 6*a*, 6*b*.

Figure 2:
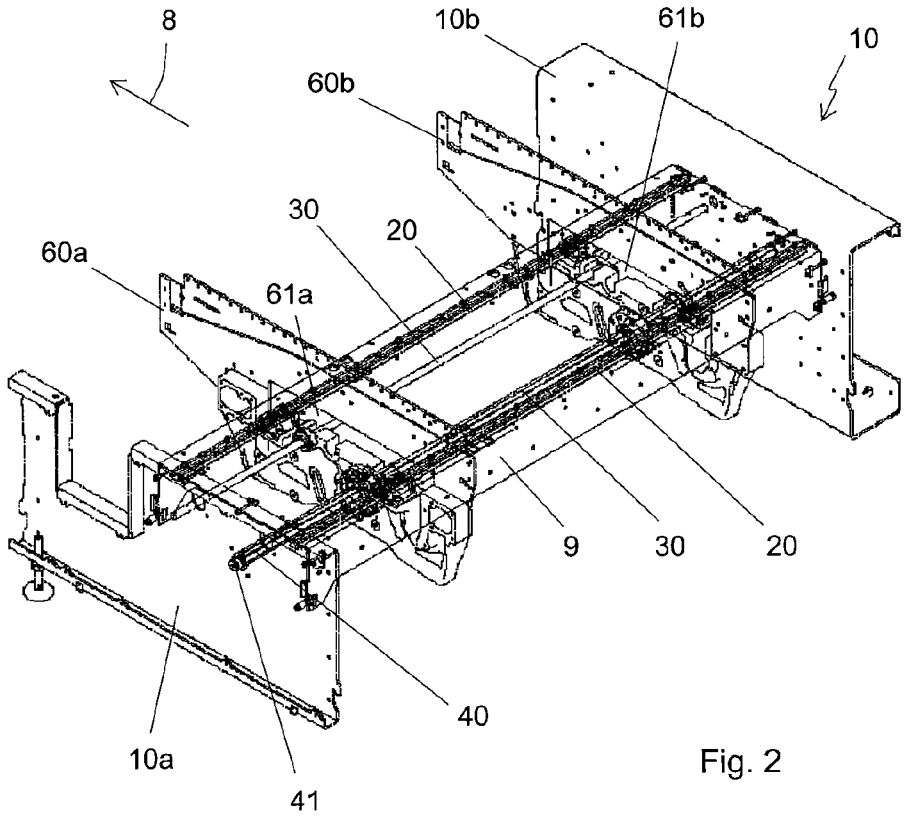
FIG. 2 is a perspective view of a bottom conveyor according to the invention.
Figure 3:
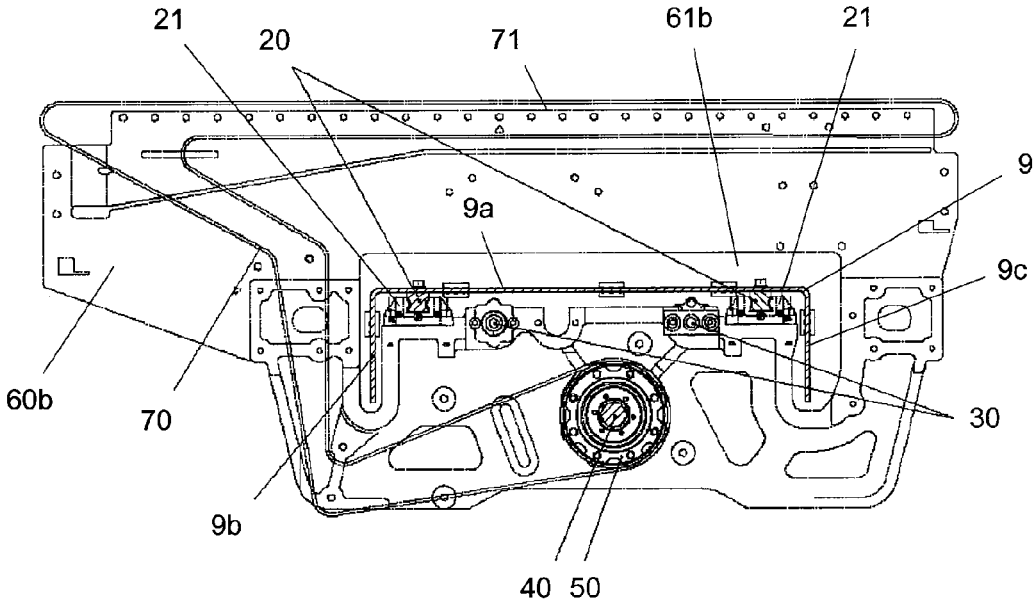
FIG. 3 is a view in cross section on the central plane of FIG. 2.

FIGS. 2 and 3 illustrate a bottom conveyor 10 according to the invention. The arrow 8 indicates the direction in which the sheet elements travel. This conveyor comprises two support structures 10*a*, 10*b* parallel to and distant from one another. Between the support structures 10*a*, 10*b* there are two longitudinal members 60*a*, 60*b*. Each longitudinal member 60*a*, 60*b* is mounted in sliding connection on a common pair of movement slides 20 secured to a U-shaped profile section 9. The profile section 9 extends transversely between the two support structures 10*a*, 10*b*, each end of the profile section 9 being built into a respective support structure 10*a*, 10*b*. In the example, the web 9*a* of the profile section is horizontal whereas the flanges 9*b*, 9*c* are vertical and face toward the bottom of the machine. The pair of movement slides 20 is mounted on the web of the profile section 9 inside the U and extends transversely between the two support structures 10*a*, 10*b*. Each movement slide 20 is a linear guide rail which, in cross section, has a biconcave shape such that a first concave face faces toward the front and a second concave face faces toward the rear of the machine (see FIG. 3).

Each longitudinal member 60*a*, 60*b* has a respective opening 61*a*, 61*b* in the shape of a U through which the profile section 9 can pass without interaction. To provide transverse guidance of the longitudinal members 60*a*, 60*b*, each longitudinal member is also equipped with a pair of runners 21 which collaborate in terms of shape with the pair of movement slides 20. Indeed, each runner 21 belonging to a longitudinal member 60*a*, 60*b* has, in cross section, the shape of a U with a horizontal web and two vertical flanges facing toward the top of the machine such that each flange has, in cross section, a convex face facing toward the inside of the U so that the convex faces of a runner 21 collaborate with the concave faces of a movement slide 20 to form a sliding connection.

Each longitudinal member 60*a*, 60*b* supports rollers (not depicted) part of which defines a hard horizontal plane 71 for guiding an endless conveyor belt 70. The belt 70 is driven by a drive pulley 50 which is rotated by a drive shaft 40 of hexagonal cross section. Each pulley 50 is mounted in sliding connection with the drive shaft 40. The drive shaft 40 extends transversely between the two support structures 10*a*, 10*b*, each end of the shaft 40 being mounted such that it is free to rotate in a respective support structure 10*a*, 10*b*. One of the ends 41 of the shaft 40 passes through the support structure 10*a* to be attached to an electric motor (not depicted).

According to the invention, the shaft 40 is situated at least partly between the flanges 9*b* and 9*c* of the profile section 9, under the web 9*a*. By virtue of this arrangement, the drive shaft 40 is no longer visible as it was in the prior art, and the machine operator can therefore no longer interact with the shaft 40, even between the longitudinal members 60*a*, 60*b*, because the shaft is protected over its entire length. As a result, the traditional protective sleeves are no longer needed. In addition, because the profile section 9 is designed to support the weight of the machine operator without deflection, the shaft 40 has a lighter structure than it did in the prior art. In practice, for a given width of machine, it is possible to reduce the cross section of the drive shaft by at least 30%, thus making it possible to reduce the cost of manufacture and the size of the shaft.

In order to return the belt 70 toward the hard horizontal plane 71, this belt is directed downward as it leaves the pulley 50 so that it passes under the profile section 9, rollers (not depicted) guiding the belt 70 in this part of the path.

A pair of parallel lead screws 30 is also provided to move the respective longitudinal members 60*a*, 60*b* along the movement slides 20. The threaded portion of each screw 30 is engaged in a transverse tapped orifice belonging to a respective longitudinal member so as to form a helical connection between said screw 30 and said longitudinal member, each screw being prevented from translational movement and free to rotate between the support structures 1*a*, 1*b*. To rotate the screws 30, there are one or more electric motors (not depicted).

Advantageously, the lead screws 30 are situated at least in part between the flanges 9*b* and 9*c* of the profile section 9, under the web 9*a*.

In a folder-gluer, the bottom transport device is generally surmounted by a belt-type top conveyor that makes it easier to convey the blanks sandwiched between the belts of the top and bottom conveyors. Advantageously, the invention also applies to the top conveyor.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A transport device for transporting sheet elements into a folder-gluer comprising:

two longitudinal support structures laterally spaced apart, at least one movement slide extending between the support structures;

at least one longitudinal member located between the support structures, at least one endless conveyor belt supported to move along each respective longitudinal member;

a drive shaft operable to drive the belt to convey sheet elements;

the at least one longitudinal member being mounted in sliding connection on the at least one movement slide to be moved along the at least one slide between the support structures and also along the drive shaft and at least one lead screw extending to the longitudinal member in a direction from one support structure, the at least one longitudinal member is in helical connection with the at least one lead screw;

a protecting device shaped to prevent user access to the drive shaft and shaped to transversely connect the two longitudinal support structures.

2. A transport device according to claim 1, wherein at least one of the movement slides is secured to the protecting device.

3. A transport device according to claim 2, wherein the protecting device comprises a profile section over the drive shaft.

4. A transport device according to claim 3, wherein the profile section has a concave face facing toward the drive shaft and in which at least part of the shaft is housed.

5. A transport device according to claim 4, wherein the profile section in cross section comprises a web and at least one flange.

6. A transport device according to claim 4, wherein the profile section in cross section comprises a web passing by the shaft and two side flanges.

7. A transport device according to claim 6, wherein the drive shaft is situated at least partially between the two flanges.

8. A transport device according to claim 5, wherein the drive shaft is situated under the web.

9. A transport device according to claim 5, wherein at least one of the movement slides is secured to the web.

10. A transport device according to claim 5, wherein at least one of the lead screws is situated under the web.

11. A transport device according to claim 6, wherein the lead screw is situated at least partially between the two flanges.

12. A transport device according to claim 1, wherein the transport device is a bottom conveyor.

13. A transport device according to claim 1, wherein the transport device is a top conveyor.

14. A transport device for transporting sheet elements into a folder-gluer comprising:

two longitudinal support structures laterally spaced apart, at least one movement slide extending laterally between the support structures;

at least one longitudinal member located between the support structures, at least one endless conveyor belt supported to move along each respective longitudinal member;

a drive shaft operable to drive the belt to convey sheet elements, the at least one longitudinal member being mounted in sliding connection on the at least one movement slide allowing the longitudinal member to be moved along the at least one slide laterally between the support structures and also along the drive shaft;

at least one lead screw extending to the longitudinal member in a direction from one of the support structures, the at least one lead screw is in helical connection with at least one longitudinal member and fixed to one of the support structures in a manner that allows the lead screw to rotate and that causes the longitudinal members to move laterally along the movement slide in response to rotation of the at least one lead screw;

a protecting device that is fixed at each end to one of the longitudinal support structures, extends longitudinally between the longitudinal support structures, is located over the drive shaft, and is shaped to prevent users from standing on the drive shaft.

* * * * *